US008531922B2

(12) United States Patent
Favre et al.

(10) Patent No.: US 8,531,922 B2
(45) Date of Patent: Sep. 10, 2013

(54) STRIKING WATCH PROVIDED WITH A GONG INSULATOR

(75) Inventors: Jerome Favre, Les Bioux (CH); Nakis Karapatis, Premier (CH)

(73) Assignee: Montres Breguet SA, L'Abbaye (CH)

( * ) Notice: Subject to any disclaimer, the term of this patent is extended or adjusted under 35 U.S.C. 154(b) by 182 days.

(21) Appl. No.: 13/229,084

(22) Filed: Sep. 9, 2011

(65) Prior Publication Data

US 2012/0063275 A1 Mar. 15, 2012

(30) Foreign Application Priority Data

Sep. 13, 2010 (EP) ..... 10176413

(51) Int. Cl.
*G04B 23/02* (2006.01)
*G04B 25/00* (2006.01)
*G08B 3/00* (2006.01)

(52) U.S. Cl.
USPC ..... 368/244; 368/269; 340/392.1

(58) Field of Classification Search
USPC .. 368/72–75, 243, 244, 269, 315; 340/392.1, 340/393.4, 398.2
See application file for complete search history.

(56) References Cited

U.S. PATENT DOCUMENTS 2,008,745 A * 7/1935 Carlson et al. ..... 340/393.4
2,054,765 A 9/1936 Campbell et al.
3,689,919 A * 9/1972 Ganter et al. ..... 340/384.71
3,760,583 A * 9/1973 Tsuruishi ..... 368/244
3,797,013 A * 3/1974 Flaig et al. ..... 340/384.71
4,255,744 A * 3/1981 Link ..... 340/392.2
4,276,625 A * 6/1981 Broghammer et al. ..... 368/75
7,742,365 B2 * 6/2010 Moteki et al. ..... 368/269
2010/0232262 A1 * 9/2010 Morata et al. ..... 368/315

FOREIGN PATENT DOCUMENTS

DE 443 387 4/1927
EP 1 914 606 A1 4/2008
EP 1 914 606 B1 7/2011

OTHER PUBLICATIONS

European Search Report issued Feb. 21, 2011, in European Application No. 10176413.2, filed Sep. 13, 2010.

* cited by examiner

*Primary Examiner* — Vit W Miska
(74) *Attorney, Agent, or Firm* — Oblon, Spivak, McClelland, Maier & Neustadt, L.L.P.

(57) ABSTRACT

The striking watch (1) includes at least one gong (3) fixed to a gong-carrier (2) and at least one hammer (4) for striking the gong. The watch further includes a magnetic gong insulator arrangement (20) for preventing any inadvertent contact between the gong and a neighboring part (5, 6) of the watch. This magnetic insulator arrangement (20) includes at least one moving permanent magnet (21) arranged on one part of the gong (3) at a distance from the gong-carrier (2) and at least one fixed permanent magnet (22, 23) arranged on a watch part (5, 6) close to the gong. This fixed permanent magnet is capable of generating a magnetic field of opposite polarity to the magnetic field of the moving permanent magnet facing the fixed permanent magnet.

14 Claims, 2 Drawing Sheets

STRIKING WATCH PROVIDED WITH A GONG INSULATOR

This application claims priority from European Patent Application No. 10176413.2 filed Sep. 13, 2010, the entire disclosure of which is incorporated herein by reference.

FILED OF THE INVENTION

The invention concerns a striking watch, which includes at least one gong fixed to a gong-carrier, and at least one hammer for striking the gong.

BACKGROUND OF THE INVENTION

Within the field of watch-making, a conventional architecture is used to make movements, which are provided with striking mechanisms, such as minute repeaters. In such embodiments, the gong or gongs used are each formed by a metal wire, generally circular in shape and placed in a parallel plane to the watch dial. The metal wire of each gong is generally arranged around the movement, in the watch frame and above a plate on which the various parts of the movement are mounted. One end or several ends of each gong is/are fixed, for example by soldering, to a gong-carrier integral with the plate, for example, which may be common to all of the gongs. The other end of each gong may generally be free.

The watch striking mechanism includes at least one hammer actuated at predetermined times. The gong vibration is generated by the impact of the corresponding hammer on the gong in proximity to the gong-carrier. Each hammer generally makes a partial rotation in the plane of the gong(s) so as to strike the corresponding gong and cause it to vibrate in its plane. Part of the vibration of the gong is transmitted to the plate by the gong-carrier.

Depending upon the shape and dimensions of the gong(s) used in a striking mechanism, inadvertent ringing of the gong (s) may occur against neighbouring metal parts in rest mode after the watch has made an abrupt movement. The longer the length of the gong, such as a cathedral gong, including at least two windings around the watch movement, the more likely it is that the problem of inadvertent ringing or accidental resonance will occur. A material with a relatively low modulus of elasticity may also contribute to inadvertent ringing. This is a drawback for a luxury watch provided with a striking mechanism of this type.

One solution to this problem is set out in EP Patent Application No. 1 914 606 A1. In this Patent Application, one or more mechanical noise insulators are provided for one or more gongs of a striking mechanism. This striking mechanism includes two cathedral gongs, secured via one end thereof to a single gong-carrier. The mechanical insulators are, for example, at least one separator piece placed between the windings of the gongs, in addition to rings regularly distributed over each gong. However, this insulator arrangement has the drawback of having a multitude of static mechanical insulator elements in the watch case, in direct proximity to each gong, which may create disturbances in the strike mode of each gong. Moreover, this set of noise insulators for each gong greatly impairs the aesthetic appearance of this type of striking mechanism.

DE Patent No. 443 387, which discloses a locking device for an alarm watch striking mechanism, may also be cited. To achieve this, a magnetic element holds the strike hammer in a wound position at a distance from the gong, when the coil of the magnetic element is powered with electricity. When the electric power to the coil is interrupted, the hammer is released and can strike the gong. However, this does not prevent the gong from striking neighbouring metal parts when the striking mechanism is in rest mode, which is a drawback.

The use of a magnetic element in the striking mechanism is also known from U.S. Pat. No. 2,054,765, but the magnetic element is only used in cooperation with a metal disc of the mechanism for adjusting the speed of the striking mechanism and not for providing gong insulating means.

SUMMARY OF THE INVENTION

It is thus an object of the invention to overcome the drawbacks of the state of the art by providing a striking watch, which uses a novel gong insulation principle to minimise the risk of inadvertent gong ringing when the watch is subjected to a shock. This novel gong insulation principle is relatively simple to implement and allows the gong to vibrate freely in strike mode, while maintaining the aesthetic appearance of the striking mechanism.

The invention therefore concerns the aforecited striking watch, which includes at least one gong secured to a gong-carrier and at least one hammer for striking the gong, wherein the watch includes a magnetic gong insulator arrangement for preventing any inadvertent contact between the gong and a neighbouring part of the watch, said arrangement including at least one moving permanent magnet arranged on one part of the gong at a distance from the gong-carrier, and at least one magnetic element arranged on a part of the watch close to the gong, the magnetic element being capable of generating a magnetic field of opposite polarity to the magnetic field of the moving permanent magnet facing the magnetic element.

Specific embodiments of the watch are defined in the dependent claims 2 to 14.

One advantage of the striking watch according to the invention lies in the fact that the gong is magnetically and not mechanically insulated to prevent any inadvertent ringing of the gong when the watch is in rest mode. The fact that the watch is provided with a magnetic gong insulator arrangement is novel in this field of mechanical watchmaking. This overcomes any prior prejudices whereby it was sought to avoid using any magnetic elements in a mechanical watch, since this could cause problems for the operation of said watch.

BRIEF DESCRIPTION OF THE DRAWINGS

The objects, advantages and features of the watch with striking mechanism will appear more clearly in the following description, particularly with reference to the drawings, in which.

DETAILED DESCRIPTION OF THE INVENTION

In the following description, those parts of the striking watch that are well known in this technical field will be only briefly described.

Figure 1:
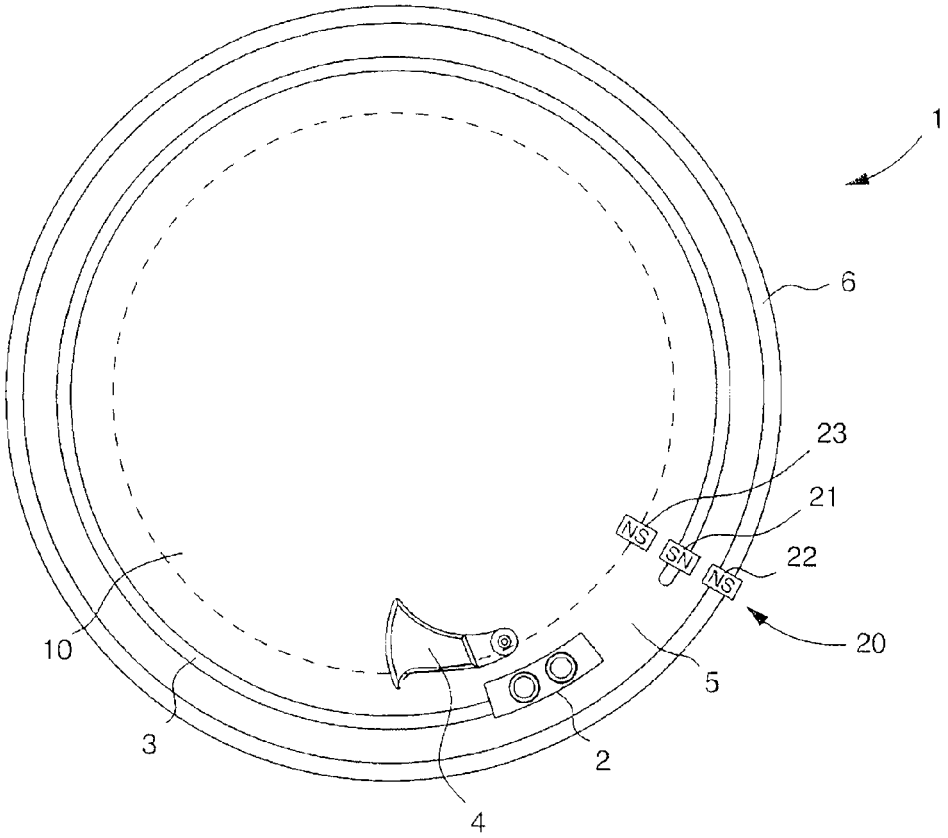
FIG. 1 is a simplified top view of a first embodiment of the interior of a striking watch with a magnetic gong insulator arrangement according to the invention.

FIG. 1 is a top view of the interior of a striking watch 1. The watch includes a well known watch movement 10, which is shown in the hatched part and generally arranged on a plate 5. The watch movement is typically a mechanical movement. Plate 5 may be surrounded by a wall 6 to define a frame which houses said watch movement. This wall 6 may also be the middle part of the watch.

Striking watch 1 mainly includes a striking mechanism which may form part of watch movement 10. This striking mechanism includes a gong 3 fixed at one end thereof to a gong-carrier 2 integral with plate 5 or the case. This first end of the gong is secured by welding or held locked between two screwed-in reverse parts of gong-carrier 2. The second end of gong 3 is generally free to move. Gong-carrier 2 projects relative to the bottom of plate 5 to hold the gong above the bottom of plate 5. The gong 3 is formed of a metal wire, which partly surrounds movement 10 and extends substantially into a plane parallel to plate 5 and to the watch dial (not shown). The metal wire of gong 3 may define a portion of a circle with an angle, for example, of between 180° or less and 360°, but preferably close to 330°.

The striking mechanism of watch 1 also includes a hammer 4, which, when actuated, can strike one part of gong 3, particularly in proximity to gong-carrier 2. This hammer may be actuated to indicate an alarm time or minute repeaters. In this first embodiment, hammer 4 is pivotably mounted relative to an axis perpendicular to the plane of gong 3. However, the hammer could also be actuated in translation along a direction perpendicular to the gong.

A magnetic gong insulator arrangement 20 is provided to prevent gong 3 from inadvertently coming into contact with one or several metal parts of the watch close to the gong, when the watch is subjected to a shock. The metal parts are, for example, parts of the watch movement, plate 5 or external parts of the watch.

The magnetic insulator arrangement 20 mainly includes at least one moving permanent magnet 21, preferably arranged in proximity to the second free end of gong 3. This moving permanent magnet 21 may be bonded to the gong or in a recess made in the gong. This permanent magnet may also be soldered to the free end part of the gong. In this embodiment, the magnetic field of the moving permanent magnet is mainly directed into the plane of the gong with the south pole facing the centre of the watch and the north pole facing the exterior of the watch. This moving permanent magnet 21 also forms an inertia-block for increasing the density of generated partials and increasing the quality factor of the gong.

The magnetic insulator arrangement 20 further includes a first magnetic element, which is a first fixed permanent magnet 22 arranged in wall 6 of the frame or middle part of the watch. This first fixed permanent magnet 22 is placed directly opposite the moving permanent magnet 21 and can have the same dimensions. However, the magnetic field of the first fixed permanent magnet 22 is of opposite polarity to the magnetic field of the moving permanent magnet 21. The north pole of the fixed permanent magnet faces the centre of the watch, whereas the south pole of the fixed permanent magnet faces the exterior of the watch. In these conditions, the gong is kept at a distance from the wall owing to the repulsion force of the two magnets 21 and 22.

If the watch is subjected to a shock, the closer the gong comes to wall 6, the more the repulsion force between the two magnets 21 and 22 will be accentuated, to the power of 4 of the distance using local approximation. This magnetically insulates the gong to prevent any contact particularly between the gong and said wall 6 of the frame, when the watch is moved abruptly. It is to be noted that permanent magnets of this type may be made with a size of 1 $mm^3$ or less, generating a magnetic field of less than 1200 Gauss. The distance separating the gong from the wall may be less than 0.3 mm. Moreover, the transverse section of the gong may define a rectangle or preferably a disc with a diameter of less than 0.8 mm.

According to this first embodiment, the magnetic gong insulator arrangement 20 may also include a second magnetic element, which is a second fixed permanent magnet 23, arranged in one part of watch movement 10. This second permanent magnet 23 is arranged opposite the moving permanent magnet 21 and has the same size as permanent magnets 21 and 22. The three permanent magnets are preferably arranged on the same line towards the centre of the watch. The magnetic field of the second fixed permanent magnet 23 is of opposite polarity to the magnetic field of the moving permanent magnet 21. The north pole of this second fixed permanent magnet faces the centre of the watch, whereas the south pole of the second fixed permanent magnet faces the exterior of the watch. This therefore also keeps gong 3 at a distance from any neighbouring part of watch movement 10, which carries the second fixed permanent magnet 23. If the watch is subjected to a shock as previously described, the closer the gong moves towards the part carrying the second permanent magnet 23, the more the repulsion force between the two magnets 21 and 23 will increase. This also ensures good magnetic insulation of the gong in the direction of the watch movement.

Of course, it is possible to envisage arranging several moving permanent magnets over the entire length of the gong, and several fixed permanent magnets in the watch, each facing one of the moving permanent magnets. The orientation of the moving permanent magnets and the orientation of the fixed permanent magnets may change along the metal wire of the gong, yet the gong is still kept at a distance from any neighbouring watch part when the watch is subjected to a shock.

It should also be noted that each fixed magnetic element may also be a coil, able to be connected to a continuous current source, to generate a magnetic field of opposite polarity to the magnetic field of the moving permanent magnet opposite the coil. Each coil may also be arranged to be disconnected from the continuous current source in conventional strike mode.

Depending upon the type of metal material used to make said gong 3, one or several moving permanent magnets 21 may be made directly by magnetising one or several parts of the gong. This type of material must thus be a ferromagnetic material (iron, nickel, steel or cobalt). It is even possible to envisage completely magnetising the entire length of the metal wire of the gong.

Figure 2A:
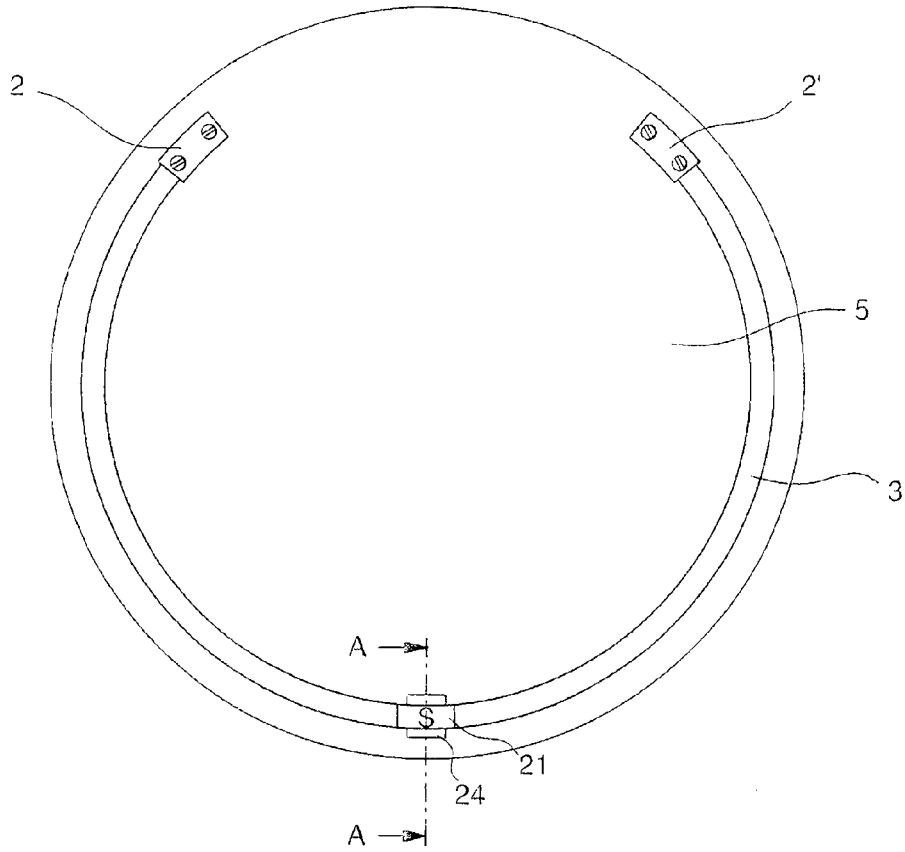
FIG. 2*a* is a simplified top view of a second embodiment of the interior of a striking watch with a magnetic gong insulator arrangement according to the invention.
Figure 2B:
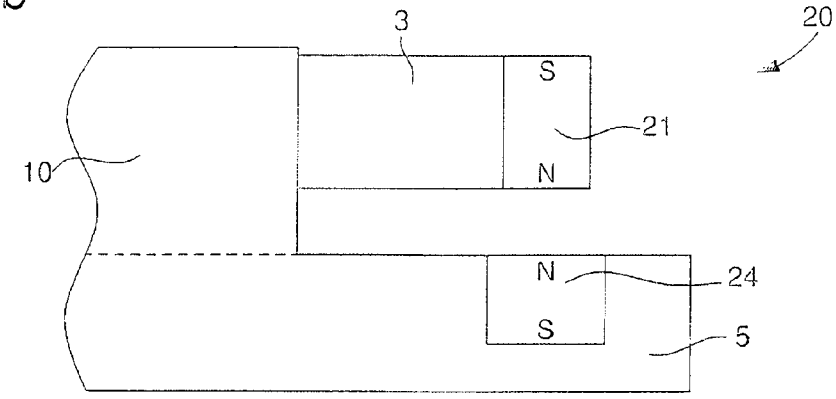
FIG. 2*b* is an enlarged, partial, diametral cross-section view along section A-A of FIG. 2*a*, of the interior of the striking watch with a magnetic gong insulator arrangement according to the invention.

FIGS. 2*a* and 2*b* show a second embodiment of striking watch 1 with the magnetic insulator arrangement 20 for gong 3. For the sake of simplification, FIG. 2*a* does not show the hammer, the wall or middle part of the watch, and watch movement 10, which is however shown in FIG. 2*b*.

In this second embodiment, it can be seen that a first end of gong 3 is secured to a first gong-carrier 2 integral with plate 5, and a second end of gong 3 is secured to a second gong-carrier 2' integral with plate 5. Of course, it is also possible to envisage securing each gong-carrier to the watch case. The metal wire of the gong forms a winding, which, in this second embodiment, extends over an angular sector of around 270°.

In this configuration, the magnetic gong insulator arrangement 20 includes a moving permanent magnet 21 preferably arranged in a median portion of the gong. The direction of orientation of the magnetic field is mainly perpendicular to plate 5, with the south pole facing the watch dial side, whereas the north pole faces the plate side. Magnetic insulator arrangement 20 must therefore include another fixed permanent magnet 24, preferably arranged in plate 5 and opposite moving permanent magnet 21. The magnetic field of fixed permanent magnet 24 is of opposite polarity to the magnetic field of moving permanent magnet 21 so as to generate a repulsion force. The south pole of this fixed permanent magnet 24 thus faces the back cover of the watch case, whereas the north pole faces the watch dial.

As in the first embodiment, gong 3 may also be provided with several moving permanent magnets, and plate 5 with several fixed permanent magnets, each opposite a corresponding moving permanent magnet. The metal wire of the gong may be made in a ferromagnetic material. In these conditions, permanent magnetisation of the median part of the gong may also be achieved, as shown in FIGS. 2*a* and 2*b*. It is also possible to envisage permanently magnetising the entire length of the metal wire.

Figure 3:
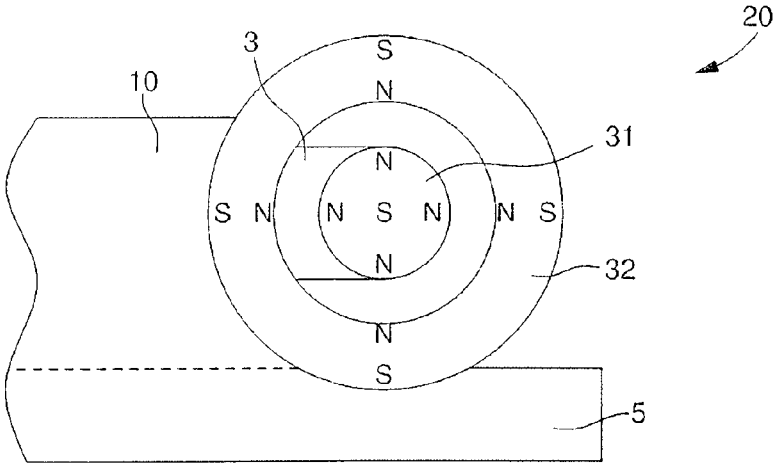
FIG. 3 is an enlarged, partial, diametral cross-section view of a third embodiment of the interior of the striking watch with a magnetic gong insulator arrangement according to the invention.

FIG. 3 shows an enlarged, partial, diametral cross-section view of a third embodiment of striking watch 1 with a magnetic insulator arrangement 20 for the gong 3. In this third embodiment, the fixed permanent magnet is a magnetised ring 32 arranged opposite and coaxial to moving permanent magnet 31 of gong 3. This magnetised ring 32 is secured to the plate and to a part of the movement as shown schematically in FIG. 3. The magnetic pole on the external periphery of moving permanent magnet 31 is identical to the magnetic pole on the internal periphery of the magnetised ring. Thus, if the watch is subjected to a shock in any direction, gong 3 is held in a stable position at a distance from the internal periphery of magnetised ring 32 as a function of the repulsion force generated by permanent magnets 31 and 32.

Several magnetised rings could also be arranged coaxially to the gong at several locations on the length of gong 3. The entire length of the magnetisable metal wire of the gong may advantageously be permanently magnetised.

From the description that has just been given, those skilled in the art may devise several variants of the striking watch with the magnetic gong insulator arrangement without departing from the scope of the invention defined by the claims. A median part of the gong may be secured to a gong-carrier integral with the plate or the middle part of the watch. The hammer may be mounted on the middle part of the watch. Instead of a moving permanent magnet mounted on the gong, a moving magnetic element may be provided, which may be another coil connected to a continuous current source for generating a magnetic field.

What is claimed is:

1. A striking watch including at least one gong secured to a gong-carrier and at least one hammer for striking the gong, wherein the watch includes a magnetic gong insulator arrangement for preventing any inadvertent contact between the gong and a neighbouring part of the watch, said arrangement including at least one moving permanent magnet arranged on one part of the gong at a distance from the gong-carrier, and at least one magnetic element arranged on a part of the watch close to the gong, the magnetic element being capable of generating a magnetic field of opposite polarity to the magnetic field of the moving permanent magnet facing the magnetic element.

2. The striking watch according to claim 1, wherein magnetic element is a fixed permanent magnet.

3. The striking watch according to claim 1, wherein the magnetic element is a coil able to be connected to a continuous current source for generating a magnetic field of opposite polarity to the magnetic field of the moving permanent magnet.

4. The striking watch according to claim 3, wherein when the watch is in strike mode, the coil is arranged to be disconnected from the continuous current source.

5. The striking watch according to claim 1, wherein the gong defines at least one portion of a circle or one portion of a rectangle around a watch movement inside a case or a frame of said watch, and in that a first end of the gong is secured to the gong-carrier, while the second end is free to move, the moving permanent magnet being arranged on the second end of the gong.

6. The striking watch according to claim 5, wherein the gong-carrier is integral with a plate on which the watch movement is mounted, and in that the magnetic element is a fixed permanent magnet mounted on or in the plate.

7. The striking watch according to claim 6, wherein the fixed permanent magnet takes the form of a magnetised ring arranged opposite and coaxial to the moving permanent magnet of the gong, the magnetic pole on the external periphery of the moving permanent magnet being identical to the magnetic pole on the internal periphery of the magnetised ring.

8. The striking watch according to claim 1, wherein the gong defines at least one portion of a circle or one portion of a rectangle around a watch movement inside a case or frame of said watch, and in that a first end of the gong is secured to a first gong-carrier, while a second end of the gong is secured to a second gong-carrier, and in that the moving permanent magnet is arranged in a median portion of the gong.

9. The striking watch according to claim 8, wherein the gong-carriers are integral with a plate on which the watch movement is mounted, and in that the magnetic element is a fixed permanent magnet mounted on or in the plate.

10. The striking watch according to claim 1, wherein it includes several gongs arranged without any contact one on top of the other, one end of each gong being secured to the same gong-carrier or to several respective gong-carriers, and in that the magnetic insulator arrangement includes a moving permanent magnet arranged on one part of each gong at a distance from the gong-carrier, the moving permanent magnets facing each other with opposite magnetic field polarities to generate a repulsion force.

11. The striking watch according to claim 10, wherein the magnetic insulator arrangement includes at least one fixed permanent magnet arranged on or in a watch plate, to which the gong-carrier is fixed, the fixed permanent magnet being opposite the moving permanent magnet of the gong closest to the plate, and with opposite magnetic field polarity.

12. The striking watch according to claim 1, wherein the moving permanent magnet is made in a ferromagnetic gong material.

13. The striking watch according to claim 12, wherein the moving permanent magnet is made over the entire length of the gong.

14. The striking watch according to claim 1, wherein several moving permanent magnets are arranged over the length of the gong, and in that several magnetic elements, which are formed by fixed permanent magnets are arranged on one or several parts of the watch close to the gong, respectively opposite each moving permanent magnet and with an opposite magnetic field polarity to each moving permanent magnet.

* * * * *